US007350678B1

(12) United States Patent
Austin

(10) Patent No.: US 7,350,678 B1
(45) Date of Patent: Apr. 1, 2008

(54) EMBROIDERY PREPARATION SYSTEM

(76) Inventor: John H. Austin, 1828 E. Calstock St., Carson, CA (US) 90746

( * ) Notice: Subject to any disclaimer, the term of this patent is extended or adjusted under 35 U.S.C. 154(b) by 10 days.

(21) Appl. No.: 11/492,727

(22) Filed: Jul. 25, 2006

(51) Int. Cl.
*D06C 15/00* (2006.01)

(52) U.S. Cl. ..... 223/72; 223/66; 223/52

(58) Field of Classification Search ..... 223/61, 223/63, 71, 84; 38/102, 102.2, 102.91; 112/103, 112/102.4; 33/613; 29/283; 269/37, 47, 269/58, 909

See application file for complete search history.

(56) References Cited

U.S. PATENT DOCUMENTS 4,767,111 A * 8/1988 Guenther ..... 269/303
4,774,778 A * 10/1988 Williams ..... 38/102.2
4,869,183 A * 9/1989 Moore, III ..... 112/103
5,433,158 A * 7/1995 Moore, III ..... 112/103
5,802,704 A * 9/1998 Woody ..... 29/708
5,934,210 A * 8/1999 Lucchese ..... 112/103
6,067,737 A * 5/2000 Guenther ..... 38/102.2
6,158,153 A * 12/2000 Morgan ..... 38/102.2
6,216,617 B1 * 4/2001 Burt, Jr. ..... 112/103

* cited by examiner

*Primary Examiner*—Gary L. Welch
*Assistant Examiner*—Andrew W Sutton
(74) *Attorney, Agent, or Firm*—Edward P. Dutkiewicz

(57) ABSTRACT

A body panel is fabricated of a generally rigid sheet with a periphery and with interior and exterior surfaces. A layer of coupling material is provided on the exterior surface. A locator panel has a periphery with interior and exterior surfaces. The interior surface of the locator panel includes a coupling material separably couplable to the coupling material of the body panel. The exterior surface of the locator panel has upstanding pins. An exterior ring and an interior locking ring with each ring having an interior and an exterior face. The lower exterior ring is removably positioned on the locator panel. The exterior face of the lower exterior ring is in contact with the pins of the locator panel. The upper interior locking ring is removably positioned within the lower exterior ring.

2 Claims, 4 Drawing Sheets

FIG 1
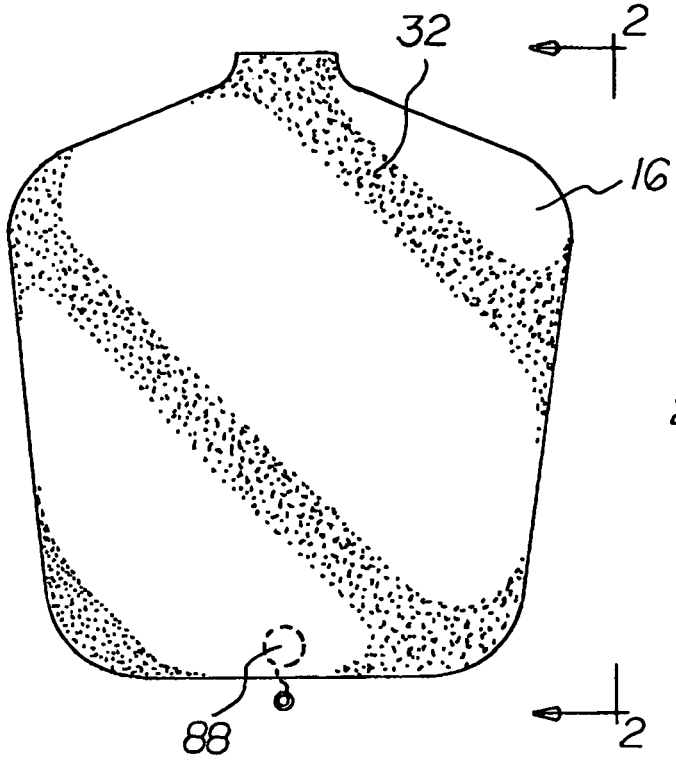
FIG 2
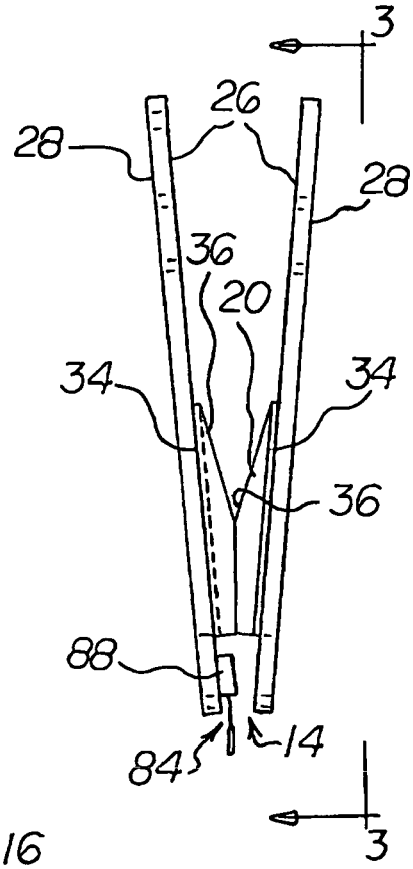
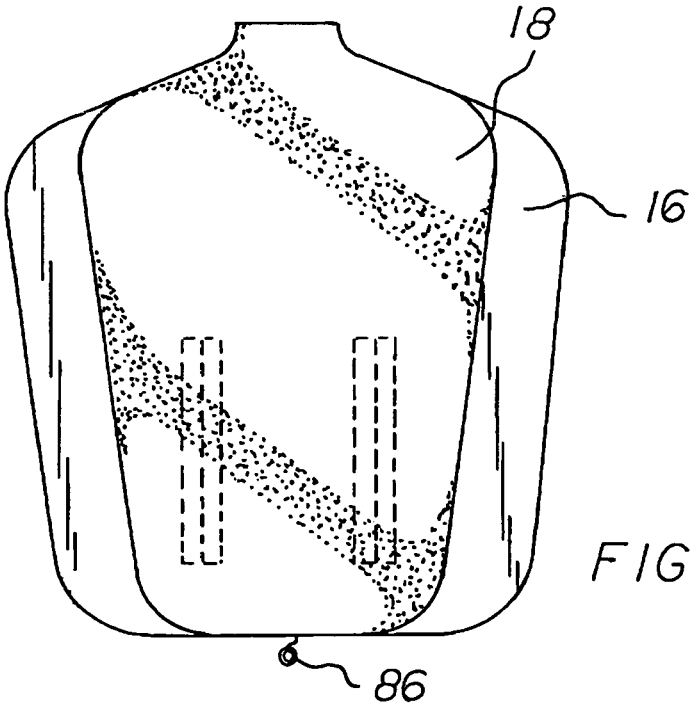
FIG 3

FIG 4
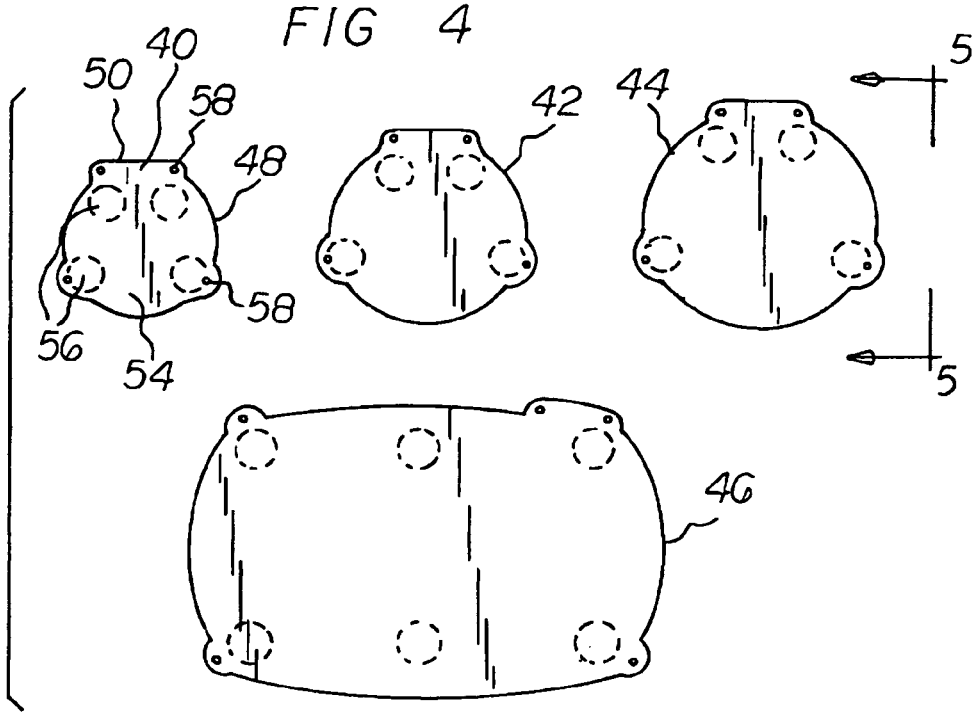
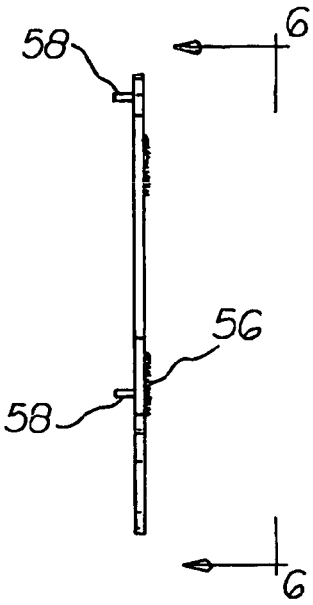
FIG 5
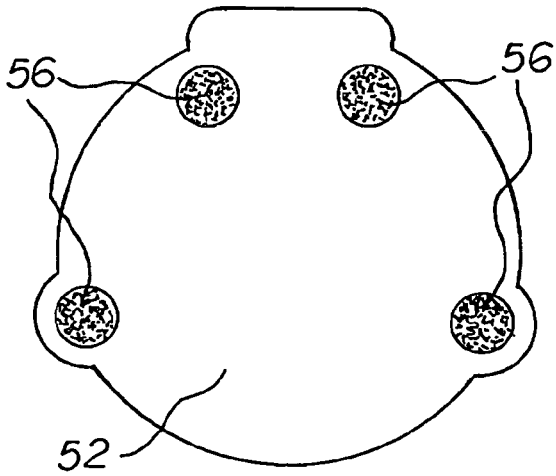
FIG 6

FIG 7
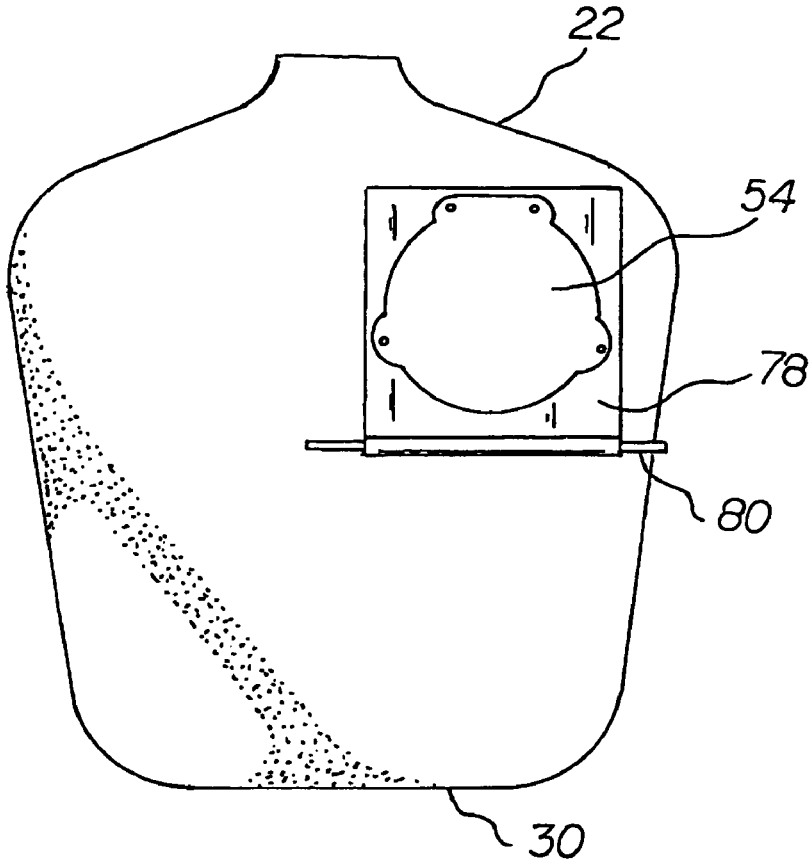
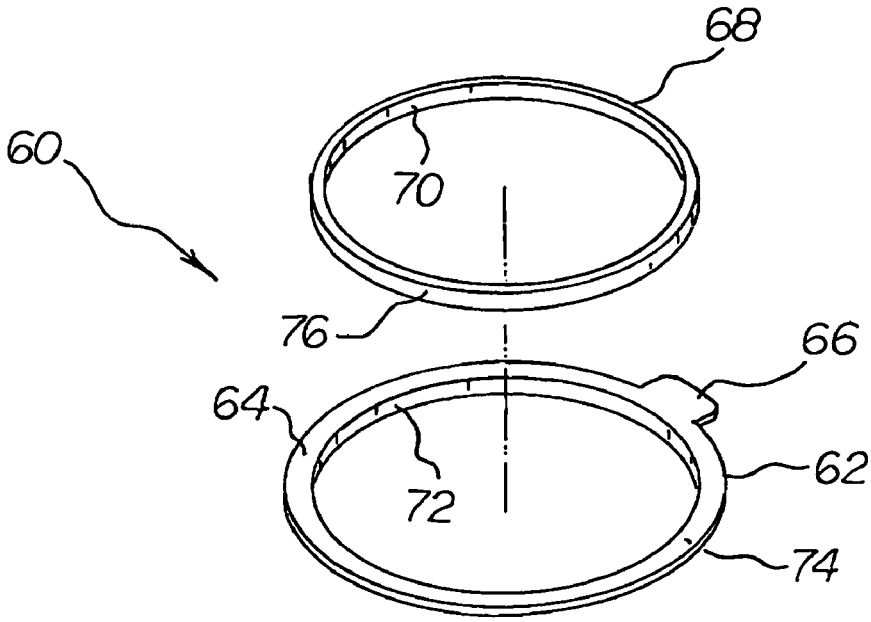
FIG 8

EMBROIDERY PREPARATION SYSTEM

BACKGROUND OF THE INVENTION

1. Field of the Invention

The present invention relates to an embroidery preparation system and more particularly pertains to supporting and positioning fabric garments to be embroidered in a convenient, repeatable and economical manner.

2. Description of the Prior Art

The use of embroidery devices of known designs and configurations is known in the prior art. More specifically, embroidery devices of known designs and configurations previously devised and utilized for the purpose of assisting in embroidering through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 6,298,800 issued Oct. 9, 2001 to Gala relates to an Embroidery Apparatus. U.S. Pat. No. 5,922,339 issued Nov. 30, 1999 to Mack relates to an Alignment Apparatus for Tubular Ringing Device. U.S. Pat. No. 5,842,430 issued Dec. 1, 1998 to Mack relates to a Tubular Ringing Device for Embroidery Rings. Lastly, U.S. Pat. No. 2,387,986 issued Oct. 30, 1945 to Evans relates to an Insignia Positioning Device.

While these devices fulfill their respective, particular objectives and requirements, the aforementioned patents do not describe an embroidery preparation system that allows supporting and positioning fabric garments to be embroidered in a convenient, repeatable and economical manner.

In this respect, the embroidery preparation system according to the present invention substantially departs from the conventional concepts and designs of the prior art, and in doing so provides an apparatus primarily developed for the purpose of supporting and positioning fabric garments to be embroidered in a convenient, repeatable and economical manner.

Therefore, it can be appreciated that there exists a continuing need for a new and improved embroidery preparation system which can be used for supporting and positioning fabric garments to be embroidered in a convenient, repeatable and economical manner. In this regard, the present invention substantially fulfills this need.

SUMMARY OF THE INVENTION

In view of the foregoing disadvantages inherent in the known types of embroidery devices of known designs and configurations now present in the prior art, the present invention provides an improved embroidery preparation system. As such, the general purpose of the present invention, which will be described subsequently in greater detail, is to provide a new and improved embroidery preparation system and method which has all the advantages of the prior art and none of the disadvantages.

To attain this, the present invention essentially comprises an embroidery preparation system. First provided is a body panel assembly. The body panel assembly has a large body panel. The body panel assembly has a small body panel. An essentially V-shaped connector is provided between the large and small body panels. Each body panel is fabricated of a generally rigid moldable material. The sheet has a periphery. The periphery is shaped to correspond to a person desirous of having a garment with embroidery. Each body panel has an interior surface. Each body panel has an exterior surface. Each body panel has a bottom edge. A layer of felt is provided on the exterior surfaces. The connector has exterior faces. The exterior faces are mechanically attached to the interior surfaces of the body panels adjacent to their bottom edges. In this manner the large and small body panels are secured in a V-shaped orientation.

A plurality of locator panels is provided. Each locator panel has a periphery. Each of the locator panels has a projection. Each of the locator panels has an interior surface and an exterior surface. Each locator panel is of a size smaller than the size of the body panels. The interior surface of each locator panel includes hook and loop fasteners. In this manner coupling to the felt of a body panel is provided. The exterior surface of each locator panel has four or five upstanding pins. The pins extend perpendicularly from the exterior surface.

A ring assembly includes a lower exterior ring. The lower exterior ring has an outwardly extending upper flange. The ring assembly has a projection. The ring assembly has an upper interior locking ring. Each ring has an interior face and an exterior face. The lower exterior ring is removably positioned on an associated locator panel. The exterior face of the lower exterior ring is in contact with the pins of its associated locator panel. The projections are rotationally aligned. The upper interior locking ring is removably positioned within the lower exterior ring.

A rectangular slip sheet is provided. The slip sheet is fabricated of a flexible plastic material. The slip sheet is positioned between the felt of a body panel and the hook and loop fasteners of an associated locator panel. In this manner the locator panel may be slid with respect to the associated body panel for proper positioning of the pins. The slip sheet has a rod. The rod is provided along one edge. In this manner a user may pull the slip sheet from between the locator panel and body panel after the locator panel is properly positioned with respect to the body panel.

Further provided is a retractor assembly. The retractor assembly has a flexible string. The retractor assembly has a housing. The housing is secured to the interior surface of the body panel adjacent to the lower edge. The string is positioned between a retracted orientation resiliently retained within the housing and an extended orientation outside of the housing. A user may move the string between the felt of the body panel and the hook and loop of the locator panel. In this manner the locator panel may be separated from the body panel.

A fabric garment is removably positioned on an associated body panel. The fabric garment has an operational area. The operation area is adapted to receive embroidery. The operation area is positioned upon the lower exterior ring while supported by pins on an associated locator panel. The upper interior locking ring is located over the operational area inside the exterior ring. In this manner the ring assembly and fabric garment may be separated from the locator panel and body panel and thereafter moved to a remote machine for embroidering. Thereafter another fabric garment on a loop assembly may be properly positioned with respect to a locator panel and body panel for another embroidering.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved embroidery preparation system which has all of the advantages of the prior art embroidery devices of known designs and configurations and none of the disadvantages.

It is another object of the present invention to provide a new and improved embroidery preparation system which may be easily and efficiently manufactured and marketed.

It is further object of the present invention to provide a new and improved embroidery preparation system which is of durable and reliable constructions.

An even further object of the present invention is to provide a new and improved embroidery preparation system which is susceptible of a low cost of manufacture with regard to both materials and labor, and which accordingly is then susceptible of low prices of sale to the consuming public, thereby making such embroidery preparation system economically available to the buying public.

Even still another object of the present invention is to provide a embroidery preparation system for supporting and positioning fabric garments to be embroidered in a convenient, repeatable and economical manner.

Lastly, it is an object of the present invention to provide a new and improved embroidery preparation system. A body panel is fabricated of a generally rigid sheet with interior and exterior surfaces. A layer of coupling material is provided on the exterior surface. A locator panel has a periphery with interior and exterior surfaces. The interior surface of the locator panel includes a coupling material separably coupling to the coupling material of the body panel. The exterior surface of the locator panel has upstanding pins. An exterior ring and an interior ring have interior and exterior faces. The exterior ring is removably positioned on the locator panel. The exterior face of the exterior ring is in contact with the pins of the locator panel. The interior ring is removably positioned within the exterior ring.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a body panel assembly constructed in accordance with the principles of the present invention.

FIG. 2 is a side elevational view of the body panel assembly taken along line 2-2 of FIG. 1.

FIG. 3 is a rear elevational view of the body panel assembly taken along line 3-3 of FIG. 2.

FIG. 4 is a front elevational view of a plurality of locator panels of varying sizes.

FIG. 5 is a side elevational view of one locator panel taken along line 5-5 of FIG. 4.

FIG. 6 is a rear elevational view of a locator panel taken along line 6-6 of FIG. 5.

FIG. 7 is a front elevational view of a body panel with a locator panel thereon and a slip sheet there between.

FIG. 8 is a perspective illustration of a ring assembly positionable on a locator panel for receiving a fabric object to be embroidered.

FIG. 9 is a front elevational view of a body panel and a ring assembly with a locator panel there between.

The same reference numerals refer to the same parts throughout the various Figures for the various alternate embodiments of the invention.

DESCRIPTION OF THE PREFERRED EMBODIMENTS

Figure 9:
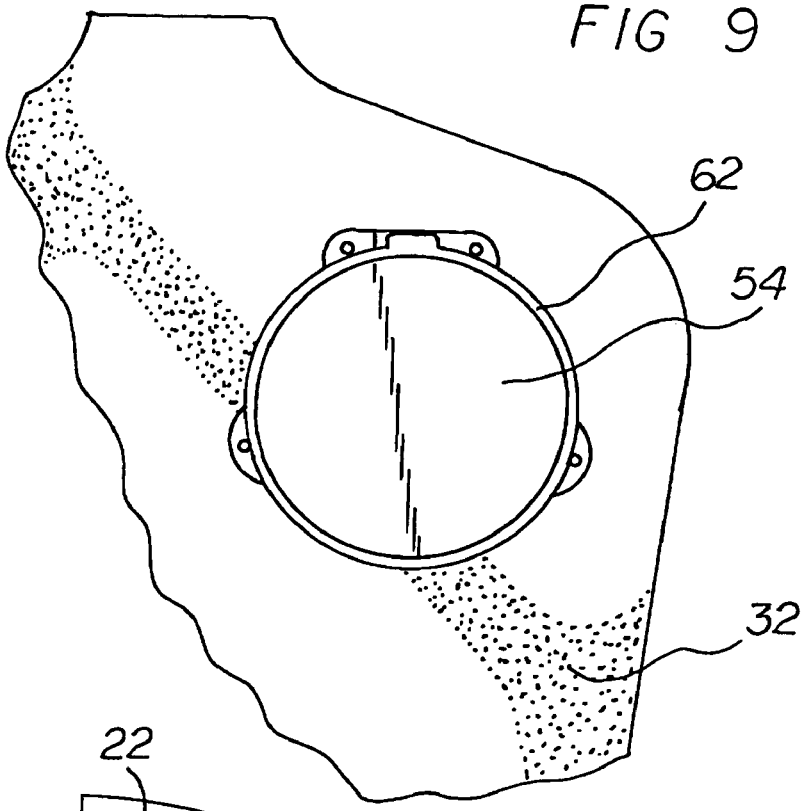
Figure 10:
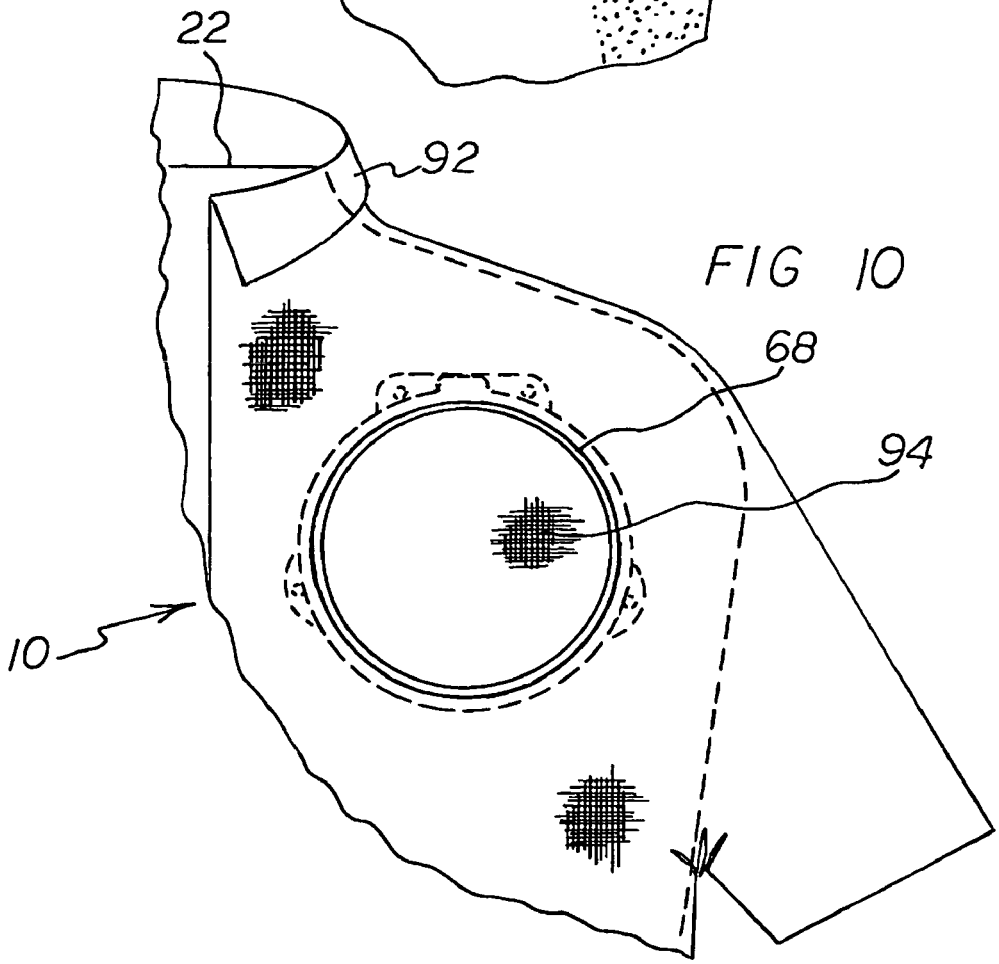
FIG. 10 is a front elevational view of a body panel and a ring assembly with a locator panel there between as seen in FIG. 9 but with a fabric object supported on the locator panel by the ring assembly.

With reference now to the drawings, and in particular to FIG. 10 thereof, the preferred embodiment of the new and improved embroidery preparation system embodying the principles and concepts of the present invention and generally designated by the reference numeral 10 will be described.

The present invention, the embroidery preparation system 10 is comprised of a plurality of components. Such components in their broadest context include a body panel, a locator panel and a ring assembly. Such components are individually configured and correlated with respect to each other so as to attain the desired objective.

First provided is a body panel assembly 14. The body panel assembly has a large body panel 16. The body panel assembly has a small body panel 18. An essentially V-shaped connector 20 is provided between the large and small body panels. Each body panel is fabricated of a generally rigid moldable material. The sheet has a periphery 22. The periphery is shaped to correspond to a person desirous of having a garment with embroidery. Each body panel has an interior surface 26. Each body panel has an exterior surface 28. Each body panel has a bottom edge 30. A layer of a coupling material 32, preferably felt, is provided on the exterior surface. The connector has exterior faces 34, 36. The exterior faces are mechanically attached to the interior surfaces of the body panels adjacent to their bottom edges. In this manner the large and small body panels are secured in a V-shaped orientation.

The body panel, in the disclosed preferred embodiment, is in the form of a torso of a person for embroidering shirts and sweaters and the like. It should be understood, however, that the body panels are adapted to take other configurations corresponding to other objects to be embroidered.

A plurality of locator panels 40, 42, 44, 46 is provided. Each locator panel has a periphery 48. Each of the locator panels has a projection 50. Each of the locator panels has an interior surface 52 and an exterior surface 54. Each locator panel is of a size smaller than the size of the body panels. The interior surface of each locator panel includes a coupling material 56, preferably hook and loop fasteners. In this manner coupling to the felt of a body panel is provided. The exterior surface of each locator panel has a plurality of upstanding pins 58, preferably four or five pins. The pins extend perpendicularly from the exterior surface.

A ring assembly 60 includes a lower exterior ring 62. The lower exterior ring has an outwardly extending upper flange 64. The ring assembly has a projection 66. The ring assembly has an upper interior locking ring 68. Each ring has an interior face 70, 72 and an exterior face 74, 76. The lower exterior ring is removably positioned on an associated locator panel. The exterior face of the lower exterior ring is in contact with the pins of its associated locator panel. The projections of the exterior ring and the locator panels are rotationally aligned. The upper interior locking ring is removably positioned within the lower exterior ring.

FIG. 4 illustrated a plurality of locator panels of various sizes and shapes. The locator panels 40, 42, 44 with four or five pins are particularly useful with circular hoops of different sizes. The locator panel 46 with a greater number of pins is adapted for use with hoops of non-circular shapes or with different hoops or positions. Such plurality of locator panels represents a set of locator panels adapted for selective use with one or more body panels. The different locator panels may also be considered to represent alternative embodiments of the invention.

A rectangular slip sheet 78 is provided. The sheet is fabricated of a flexible plastic material. It is of a size greater than the locator panel but smaller than the body panel. The slip sheet is positioned between the felt of a body panel and the hook and ring fastener of an associated locator panel. The locator panel is adapted to be slid with respect to the associated body panel for proper positioning of the pins. The slip sheet has a rod 80. The rod is provided along one edge. In this manner a user may pull the slip sheet from between the locator panel and body panel after the locator panel is properly positioned with respect to the body panel.

Further provided is a retractor assembly 84. The retractor assembly has a flexible string 86. The retractor assembly has a housing 88. The housing is secured to the interior surface of the body panel adjacent to the lower edge. The string is positioned between a retracted orientation resiliently retained within the housing and an extended orientation outside of the housing. In this manner a user may move the string between the felt of the body panel and the hook and loop fasteners of the locator panel. The locator panel may thus be separated from the body panel.

A fabric object 32, preferably a garment, is removably positioned on an associated body panel. The fabric garment has an operational area 94. The operation area is adapted to receive embroidery. The operation area is positioned upon the lower exterior ring. The operation area is supported by pins on an associated locator panel. The upper interior locking ring is located over the operational area inside the exterior ring. In this manner the ring assembly and fabric garment may be separated from the locator panel and body panel and then moved to a remote machine for embroidering. Thereafter another fabric garment and ring assembly may be properly positioned with respect to the previously utilized locator panel and body panel for another embroidering. Proper and repeatable positioning of the embroidery on garments is assured by the retention of the locator panel in the same position on the body panel.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An embroidery preparation system comprising:

a body panel fabricated of a generally rigid sheet with an interior and exterior surface and with a layer of coupling material on the exterior surface;

a locator panel having a periphery with interior and exterior surfaces, the interior surface of the locator panel having a coupling material for separable coupling to the coupling material of the body panel, the exterior surface of the locator panel having upstanding pins; and an exterior ring and an interior ring, each ring having interior and exterior faces, the exterior ring being removably positioned on the locator panel with the exterior face of the exterior ring in contact with the pins of the locator panel, the interior ring being removably positioned within the exterior ring; and a retractor assembly including a flexible string and a housing secured to the interior surface of the body panel retaining the string, the string being positioned between a retracted orientation resiliently retained within the housing and an extended orientation outside of the housing whereby a user may move the string between the body panel and the locator panel for the separation of the locator panel from the body panel.

2. An embroidery preparation system for supporting and positioning a fabric garment to be embroidered in a convenient, repeatable and economical manner comprising, in combination:

a body panel assembly having a large body panel and a small body panel with an essentially V-shaped connector there between, each body panel being fabricated of a generally rigid moldable material with a periphery shaped to correspond to a person desirous of having a garment with embroidery, each body panel having an interior surface and an exterior surface with a bottom edge and with a layer of felt on the exterior surface, the connector having exterior faces mechanically attached to the interior surfaces of the body panels adjacent to their bottom edges to thereby secure the large and small body panels in a V-shaped orientation;

a plurality of locator panels, each locator panel having a periphery with a projection with an interior surface and an exterior surface and having a size smaller than the size of the body panels, the interior surface of each locator panel including hook and loop fasteners for separable coupling to the felt of a body panel, the exterior surface of each locator panel having a plurality of upstanding pins extending perpendicularly from the exterior surface;

a ring assembly including a lower exterior ring having an outwardly extending upper flange with a projection and with an upper interior locking ring, each ring having an interior face and an exterior. face, the lower exterior ring being removably positioned on an associated locator panel with the exterior face of the lower exterior ring in contact with the pins of its associated locator panel and with the projections rotationally aligned, the upper interior locking ring being removably positioned within the lower exterior ring;

a rectangular slip sheet fabricated of a flexible plastic material positioned between the felt of a body panel and the hook and ring fastener of an associated locator panel whereby the locator panel may be slid with respect to the associated body panel for proper positioning of the pins, the slip sheet having a rod along one edge for allowing a user to pull the slip sheet from between the locator panel and body panel after the locator panel and its pins are properly positioned with respect to the body panel;

a retractor assembly including a flexible string and a housing secured to the interior surface of the body panel adjacent to the lower edge retaining the string, the string being positioned between a retracted orientation resiliently retained within the housing and an extended orientation outside of the housing whereby a user may move the string between the felt of the body panel and the hook and loop fasteners of the locator panel for the separation of the locator panel from the body panel; and a fabric garment removably positioned on an associated body panel and having an operational area adapted to receive embroidery, the operational area being positioned upon the lower exterior ring supported by pins on an associated locator panel with the upper interior locking ring being located over the operational area and inside the exterior ring whereby the ring assembly and fabric garment may be separated from the locator panel and body panel and then moved to a remote machine for embroidering and thereafter another fabric garment and loop assembly may be properly positioned with respect to a locator panel and body panel for another embroidering.

* * * * *